United States Patent [19]

Pelcin

[11] 4,127,291

[45] Nov. 28, 1978

[54] DOOR FASTENING APPARATUS

[75] Inventor: Albert L. Pelcin, Aurora, Ohio

[73] Assignee: The Eastern Company, Cleveland, Ohio

[21] Appl. No.: 836,785

[22] Filed: Sep. 26, 1977

[51] Int. Cl.[2] ..... E05C 3/04

[52] U.S. Cl. ..... 292/54; 292/218; 292/241; 292/DIG. 32

[58] Field of Search ..... 292/31, 54, 56, 241, 292/240, 218, DIG. 32, 202; 403/388, 386, 389, 390

[56] References Cited

U.S. PATENT DOCUMENTS

| | | | |
|---|---|---|---|
| 1,835,100 | 12/1931 | Symington | 292/218 |
| 1,919,328 | 7/1933 | Hansen | 292/218 |
| 1,952,112 | 3/1934 | Bartsch | 292/241 X |
| 2,578,397 | 12/1951 | Brown | 403/388 |
| 2,627,950 | 2/1953 | Dath | 292/241 |
| 3,366,433 | 1/1968 | Cann | 292/218 X |

FOREIGN PATENT DOCUMENTS

| | | | |
|---|---|---|---|
| 1,203,406 | 1/1960 | France | 403/388 |
| 2,308,767 | 11/1976 | France | 292/DIG. 32 |

OTHER PUBLICATIONS

Part No. 7502, "Two Point Cam Type Door Lock", Eberhard Manufacturing Co., 6/21/74.

Part No. 7503, "Three Point Cam Type Door Lock", Eberhard Manufacturing Co., 6/21/74.

Part No. 7507, "Three Point Cam Type Door Lock", Eberhard Manufacturing Co., 4/2/75.

*Primary Examiner*—Rodney H. Bonck

*Attorney, Agent, or Firm*—David A. Burge Co.

[57] ABSTRACT

A door fastening apparatus, particularly well suited for fastening in closed positions the rear and side doors of truck bodies, includes an elongate tubular shaft rotatable to position a plurality of latch members in door locking engagement with a plurality of keeper members. A first latch member is rigidly permanently secured to the shaft near one end of the shaft. A second latch member is secured to the shaft near its opposite end by a bolted connection. The bolted connection permits the truck body manufacturer to cut the shaft to length depending on the height of the truck, whereafter the second latch member may be fastened in place without any need for welding. The second latch member is mounted on the outside of the shaft. A plug member is inserted into the sawed-off, open end of the tubular shaft. The second latch member and the plug member captivate the shaft wall. A bolt extends through aligned holes formed in the second latch member and in the shaft wall, and is threaded into a hole in the plug to form a rigid connection having an appearance substantially identical to a conventional welded connection.

5 Claims, 6 Drawing Figures

DOOR FASTENING APPARATUS

BACKGROUND OF THE INVENTION

1. Field of the Invention

The present invention relates to door control mechanisms of the type used for securing and maintaining pivoted doors in closed, locked positions, particularly pivoted or swingable doors of truck bodies, trailers or large cargo containers, and the like.

2. Prior Art

Load carrying compartments of truck and trailer bodies and transport cargo containers typically provide pivoted double doors on the rear thereof for loading and unloading the compartments. In addition, truck and trailer bodies often include one or more single pivoted doors on the sides thereof to facilitate loading and unloading. Because the rear door opening is essentially coextensive with the rear of the load compartment, cross-bracing is lacking and the doors are readily distortable due to the application of skewed loads. Door control mechanisms are used with such doors to retain the doors in a closed position and to reduce or eliminate "racking" of the door panels. Door control mechanisms employed in this capacity typically include elongate shafts extending substantially the full height of their associated doors and having latch members at their ends engagable with keeper members affixed to the door frames or compartment bodies.

Conventional door control mechanisms of this type are limited in their use to doors having a predetermined height inasmuch as their shafts are of predetermined, nonadjustable, length, and have latch members and handle attachments welded thereto. Consequently, a manufacturer of trailers employing doors of different heights must order and maintain a stock of door control mechanisms of various lengths commensurate with the heights of doors employed in the trailers being manufactured. Maintaining a large inventory of different length door control mechanisms is costly and requires a substantial amount of storage space.

Since truck bodies, trailer bodies and cargo containers are subjected to corrosive environments, it is customary to protectively finish their hardware as by plating. Often times a plated finish is overcoated with a layer of thermosetting polymer to enhance corrosion resistance. Once this hardware has been protectively finished, it cannot be subjected to welding operations or the finish will be destroyed. Accordingly, it is customary for all fabrication steps which would disturb a protective finish on container hardware, such as welding, to be effected at the factory prior to the application of a protective finish. Approaches which conflict with this practice are not found to be readily accepted in the industry, particularly where the resulting product has an appearance different than that of previously accepted products.

SUMMARY OF THE INVENTION

The present invention takes into account the foregoing and other factors and drawbacks of the prior art, and provides novel and improved door control mechanisms which may be manufactured of one length and which may be readily and inexpensively modified by manufacturers of trailers, truck bodies, cargo containers and the like in order to fit load compartments of various heights. The required modification procedures may be quickly and easily implemented, and minimize damage to protectively finished surfaces. Moreover, the resulting product has an appearance which is practically identical to presently accepted products.

Door control mechanisms embodying the preferred practice of the invention include an elongate shaft journaled by a plurality of bearing members. The bearing members are mountable on a door and journal the shaft for rotation about an axis parallel to and spaced from the pivot axis of the door. A handle is affixed to the shaft for rotating the shaft between locked and unlocked positions. A retainer is mountable on the door to receive and hold the handle in a locked position. A first latch member is affixed to one end of the shaft, conveniently by welding. The shaft is normally shipped by the manufacturer of the door control mechanism without a second latch element on the other shaft end. In addition, the shaft of the shipped door control mechanism is normally as long as the longest door control mechanism required by the trailer or truck body manufacturer.

When the door control mechanism is ready to be assembled on a completed truck body, trailer or cargo container, the body or container manufacturer cuts the shaft to length, by using a conventional hacksaw or the like, drills a single hole in the cut-to-length shaft, and bolts the second latch element to the shaft with components shipped by the door control mechanism manufacturer.

The bolted connection used to hold the second latch element in place employs a plug which is slipped into the open end of the cut-to-length tubular shaft. A bolt, extends through aligned holes formed in the second latch element and the shaft, and is threaded into a hole formed in the plug. During assembly, the plug is positioned so that the threaded opening is visible through the drilled hole in the shaft end. The bolt is passed through the holes of the second latch element and the shaft, and is threaded into the hole in the plug. The plug is configured to fit snugly within the open end of the shaft.

The second latch element preferably has a semicylindrical spacer member connected to it. In the assembled condition, the spacer member abuts an adjacent bearing member and acts to axially position the shaft relative to the bearing member. During assembly, the spacer member engages the peripheral wall of the shaft and acts to prevent rotation of the second latch member relative to the shaft as the bolt is threaded into place.

The resulting bolted-in-place latch element has an appearance quite like that of a conventionally welded-in-place latch element. Moreover, no welding is required to mount this latch element in place, and the protective finish applied to the shaft and to the latch element is not destroyed in areas which are exposed to view. The plug has a headed end which closes and covers the cut-off end of the elongate shaft to conceal any roughness which may result from the cutting of the shaft.

It is an object of this invention to provide a novel and improved door control mechanism for swingable doors.

Another object of the invention is to provide a door control mechanism which can be readily and inexpensively modified to fit doors of various heights.

Other objects and a fuller understanding of the invention may be had by referring to the following description and claims taken in conjunction with the accompanying drawings.

DESCRIPTION OF THE PREFERRED EMBODIMENT

Figure 1:
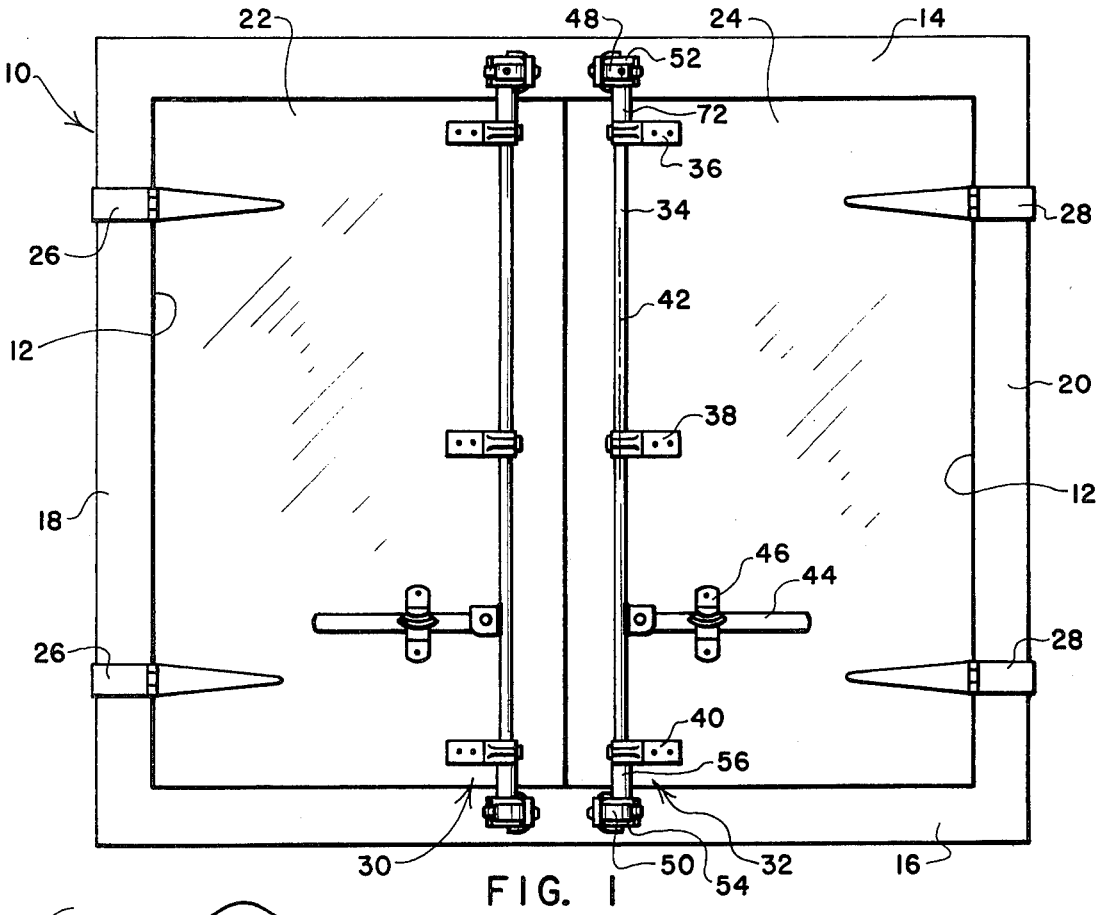
FIG. 1 is a side elevational view of the rear of a trailer body illustrating a pair of door control mechanisms employing principles of the present invention.

Referring to FIG. 1, a rear section of a load carrying compartment such as a truck body, a trailer body, or a cargo container, is indicated generally by the numeral 10. The compartment 10 has a door opening 12 defined by upper and lower transverse frame members 14, 16, and upright side frame members 18, 20. As will be apparent, the door opening 12 is substantially coextensive with the rear of the load carrying compartment 10. A pair of doors 22, 24 are pivotally mounted by hinges 26, 28 on the side frame members 18, 20 for opening and closing movements. When the doors 22, 24 are closed, they extend in substantially a common plane with the door frame members 14, 16, 18, 20.

Door control mechanisms, indicated generally by the numerals 30, 32, are provided on the outside faces of the doors 22, 24. Since the door control mechanisms 30, 32 are mirror images of each other, only the mechanism 32 will be described.

The door control mechanism 32 includes a shaft 34 formed from a length of cylindrical tubing. A plurality of bearing members 36, 38, 40 are supported on the door 24 at vertically spaced locations. The bearing members 36, 38, 40 journal the shaft 34 for rotation about a longitudinal axis 42. The axis 42 extends parallel to and is spaced from the axis of door movement afforded by the hinges 28.

The shaft 34 carries a handle 44 which may be used to rotate the shaft 34 about the axis 42 between locked and unlocked positions. A retainer assembly 46 is affixed to the door 24 for holding the handle 44 in its locked position.

Latch members 48, 50 are secured to opposite ends of the shaft 34. Keeper members 52, 54 are affixed to the upper and lower transverse frame members 14, 16. The latch members 48, 50 are rotatable with the shaft 34 into and out of latching engagement with the keeper members 52, 54.

The lower latch member 50 is affixed rigidly and permanently to the lower end of the shaft 34 as by welding. The lower latch member 50 carries an integral semi-cylindrical spacer member 56 which extends upwardly into engagement with the bottom of the lower bearing member 40 to prevent axial upward movement of the shaft 34 in the bearing members 36, 38, 40.

In order to render the control mechanism 32 usable with doors of various heights, the mechanism 32 is shipped to manufacturers of load carrying compartments with the shaft 34 being sufficiently long to be used on the tallest of their doors. During installation of the mechanism 32, the shaft 34 is cut to length at its upper end and the upper latch member 48 is bolted in place in a manner which will be described. By this arrangement, manufacturers of load carrying compartments are provided with substantially greater flexibility in scheduling production of compartments of various heights without requiring rush orders of door control mechanisms and without requiring the establishment and maintenance of substantial inventories of door control mechanisms of various lengths. In addition, in accordance with the principles of this invention, the appearance of the installed upper latch member 48 is designed to be substantially identical with those used in conventional door control mechanisms, whereby any reluctance on the part of the customer to accept the product is avoided.

Figure 2:
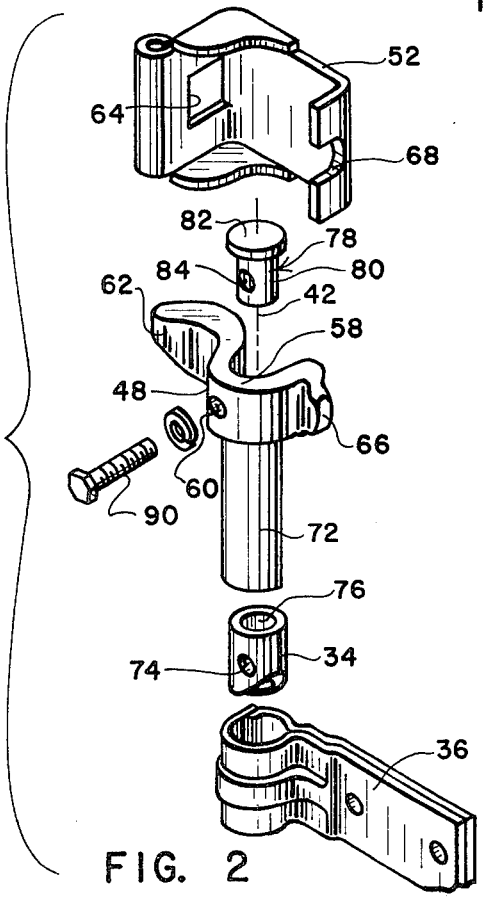
FIG. 2 is an exploded perspective view of components of the embodiment of FIG. 1.
Figure 3:
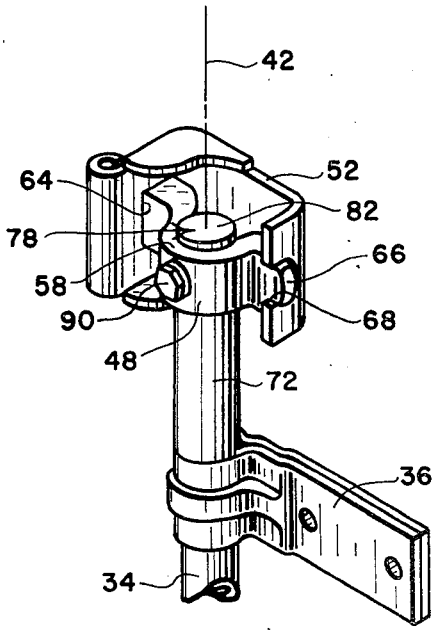
FIG. 3 is a perspective view of the components of FIG. 2 in their assembled, door-locked configuration.

Referring to FIG. 2, the upper latch member 48 has a semi-cylindrical body portion 58 with an unthreaded hole 60 formed therethrough to intersect the longitudinal axis 42 of the shaft 34. The upper latch member 48 also includes a latch portion 62 configured to be received in a hole 64 formed in the upper keeper member 52 to hold the door 24 in its closed position. The latch member 48 additionally includes an anti-racking tab 66 configured to be received in a slot 68 formed in the keeper member 52. When the tab 66 is received in slot 68, as best seen in FIG. 3, the mating engagement between the latch member 48 and the keeper member 52 assists in supporting the door 24 against racking distortion.

The latch member 48 carries a semi-cylindrical spacer member 72 which extends downwardly into abutting engagement with the upper surface of the upper bearing member 36. Just as the spacer member 56 extends upwardly into engagement with the lower bearing member 40 to prevent upward axial movement of the shaft 34, the spacer member 72 cooperates with the bearing member 36 to prevent downward axial movement of the shaft 34.

The upper latch member 48 is substantially identical with the lower latch member 50, the two being mirror images of each other. The principal difference between the latch members 48, 50 lies in the provision of an unthreaded hole 60 in the semi-cylindrical body portion 58 of the upper latch member 48. The latch members 48, 50 are made by identical manufacturing techniques except that the latch member 48 undergoes an additional manufacturing step in the formation of the hole 60.

During assembly of the load carrying compartment 10 by its manufacturer, the shaft 34 is cut to length in any suitable fashion, as by the use of a hacksaw, bandsaw, or other suitable cutting device, and a hole 74 is drilled through the wall of the shaft 34 near the shaft's open upper end 76. The bearing members 36, 38, 40 are installed on the shaft 34 and are secured in place on the door 24 with the spacer member 56 positioned in engagement with the lower surface of the lower bearing member 40.

A headed plug 78 is positioned in the shaft's open upper end 76. The plug 78 has a cylindrical body 80 configured to slip fit within the open upper end 76, and a head 82 configured to close and cover the sawed-off open upper end 76. A threaded hole 84 is provided in the plug body 80. The plug 78 is positioned in the open upper end of the shaft 34 with its threaded hole 84 aligned with the shaft hole 74. The latch member 48 is positioned adjacent the outer wall of the shaft 34 with its hole 60 aligned with the shaft and plug holes 74, 84. A hardened, hex headed cap screw 90 is inserted through the holes 60, 74 and is threaded into the plug hole 84 to clamp the latch member 48 securely in place on the upper end region of the shaft 34.

The generally semi-cylindrical and cylindrical surfaces afforded by the latch body 58 and the plug body 80 matingly engage the outer and inner walls of the shaft 34 and provide a large bearing area against the shaft walls thereby minimizing or eliminating the possiblility of wrinkling or failure of the thin shaft wall. The plug member 78 is configured so that it is not rotatable inside the shaft 34 and accordingly acts as a non-rotatable nut during threading of the bolt 90. The spacer member 72 matingly engages the outer wall of the shaft 34, and acts as a backup for the latch member 48 to prevent its rotating during threading of the bolt 90.

Figure 4:
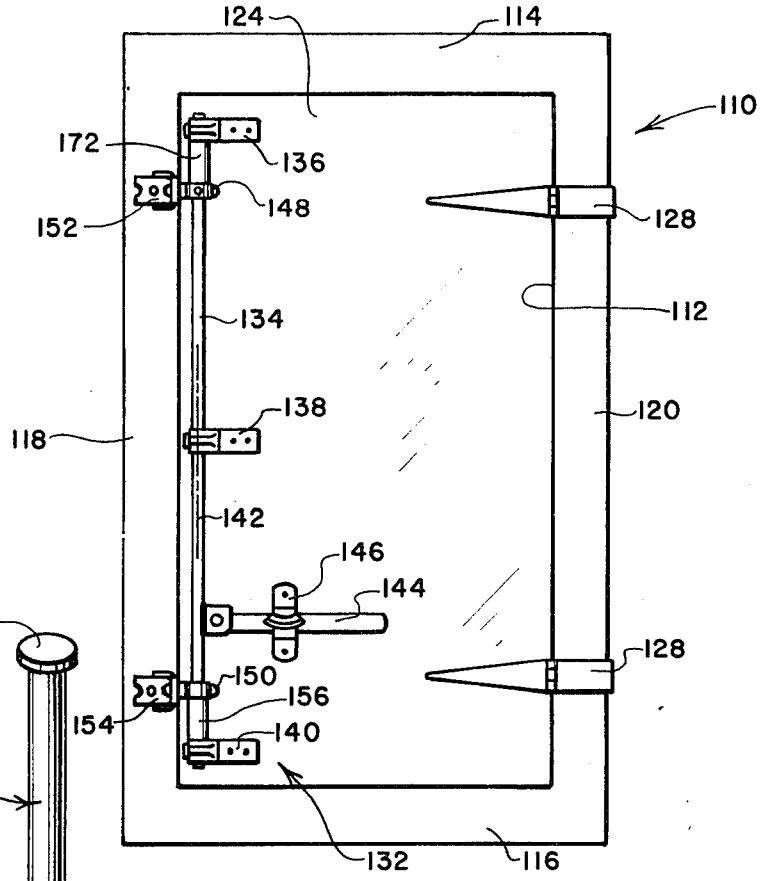
FIG. 4 is a side elevation view of another door control mechanism embodiment employing principles of the present invention.

Referring to FIG. 4, there is illustrated a section of a load carrying compartment 110 such as a truck body, a trailer body or a cargo container having a door opening 112 defined by upper, lower and sidewall portions 114, 116, 118, 120. A single door 124 is mounted by hinges 128 for opening and closing movements into and out of substantially co-planar relation with the wall portions 114, 116, 118, 120.

A door control mechanism 132 is provided for selectively retaining the door 124 in its closed position. The mechanism 132 includes an elongate shaft 134 formed from cylindrical tubing and mounted on the door 124 by a plurality of bearing members 136, 138, 140. In a manner similar to that of the previously described embodiment, the shaft 134 is mounted for rotation about a longitudinal axis 142 which is parallel to and spaced from the axis of door movement afforded by the hinges 128.

The shaft 134 carries a handle 144 which is used to rotate the shaft 134 about its axis 142 between locked and unlocked positions. A retainer assembly 146 is provided on the door 124 for holding the handle 144 in its locked position.

Latch members 148, 150 are secured to opposite end regions of the shaft 134. Keeper members 152, 154 are affixed to the sidewall portion 118. The latch members 148, 150 are rotatable with the shaft 134 into and out of latching engagement with the keeper members 152, 154.

The lower latch member 150 is affixed rigidly and permanently to the lower end region of the shaft 134 as by welding. The lower latch member 150 carries an integral semi-cylindrical spacer member 156 which extends downwardly into engagement with the upper surface of the lower bearing member 140 to prevent axial downward movement of the shaft 134 in the bearing members 136, 138, 140.

In order to render the control mechanism 132 usable with doors of various heights, the mechanism 132 is shipped to manufacturers of load carrying compartments with the shaft 134 being sufficiently long to be used on the tallest of their doors. During installation of the mechanism 132, the shaft 134 is cut to length at its upper end and the upper latch member 148 is then bolted in place in a manner much like that previously described.

Figure 5:
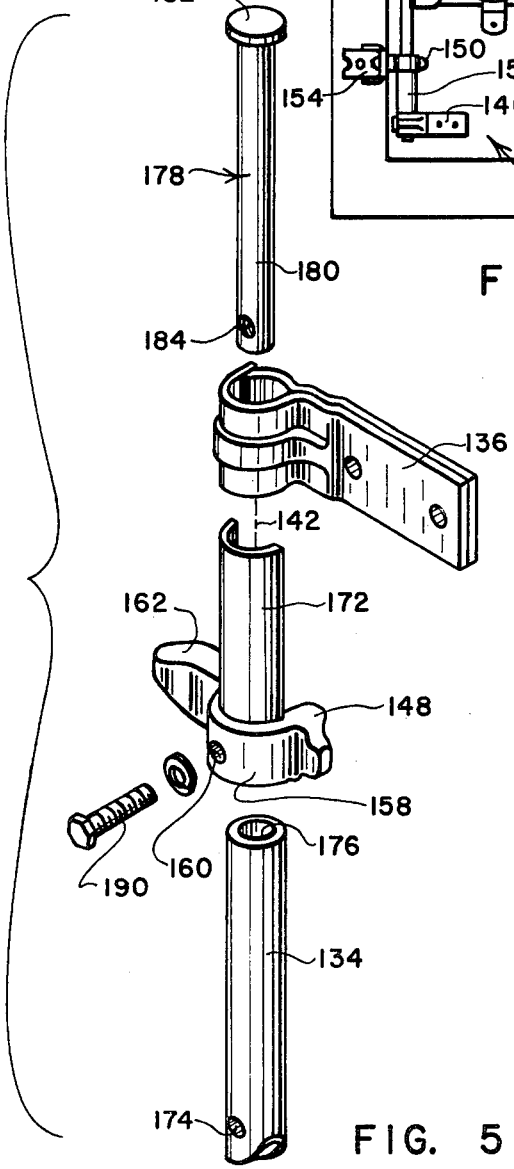
FIG. 5 is an exploded perspective view of components of the embodiment of FIG. 4; and, FIG. 6 is a perspective view of components of the embodiment of FIG. 4 in their assembled, door-locked configuration.
Figure 6:
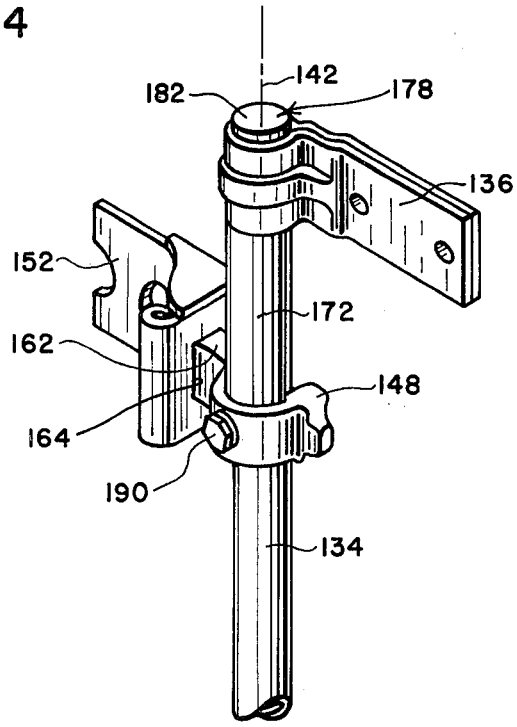

Referring to FIG. 5, the upper latch member 148 has a semi-cylindrical body portion 158 with an unthreaded hole 160 formed therethrough to intersect the longitudinal axis 142 of the shaft 134. The upper latch member 148 also has a latch portion 162 configured to be received within a hole 164 formed in the keeper member 152, as is best seen in FIG. 6.

The latch member 148 carries a semi-cylindrical spacer member 172 which extends upwardly into abutting engagement with the bottom surface of the upper bearing member 136. Just as the spacer member 156 extends downwardly into engagement with the lower bearing member 140 to prevent downward axial movement of the shaft 134, the spacer member 172 cooperates with the upper bearing member 136 to prevent upward axial movement of the shaft 134.

The upper latch member 148 is substantially identical with the lower latch member 150, the two being mirror images of each other. A further difference lies in the provision of the unthreaded hole 160 in the semi-cylindrical portion 158 of the upper latch member 148. The latch members 148, 150 are made by identical manufacturing techniques except that the latch member 148 undergoes an additional manufacturing step in the formation of the threaded hole 160.

During assembly of the load carrying compartment 110 by its manufacturer, the shaft 134 is cut to length in any suitable fashion, as by the use of a hacksaw, bandsaw, or other suitable cutting device. A hole 174 is drilled through the wall of the shaft 134. The bearing members 136, 138, 140 are positioned on the shaft 134 and are secured to the door 124 with the spacer member 156 positioned to engage the upper surface of the lower bearing member 140.

A headed elongate plug 178 is positioned in the shaft's open upper end 176. The plug 178 has a cylindrical body 180 configured to slip fit within the open upper end 176, and a head 182 configured to close and cover the sawed-off open upper end 176. A threaded hole 184 is provided in the plug 178.

During assembly, the plug 178 is positioned in the open upper end of the shaft 134 with its threaded hole 184 aligned with the shaft hole 174. The latch member 148 is positioned adjacent the outer wall of the shaft 134 with its hole 160 aligned with the shaft and plug holes 174, 184. A hardened, hex headed cap screw 190 is inserted through the holes 160, 174 and is threaded into the plug hole 184 to clamp the latch member 148 securely in place on the upper end of the shaft 134.

The generally semi-cylindrical and cylindrical surfaces afforded by the latch body 158 and the plug body 180 matingly engage the outer and inner walls of the shaft 134 and provide a large bearing area against the shaft walls thereby minimizing or eliminating the possiblility of wrinkling or failure of the thin shaft wall. The plug member 178 is configured so that it is not rotatable inside the shaft 134 and accordingly acts as a non-rotatable nut during threading of the bolt 190. The spacer member 172 matingly engages the outer wall of the shaft 134, and acts as a backup for the latch member 148 to prevent its rotating during threading of the bolt 190.

As will be apparent, the door control mechanism 132 differs from the door control mechanism 32 substantially only in the relative positions of their respective bearing members and latch members, in the location of their respective keeper members, and in the lengths of the plugs 78, 178. In the mechanism 32, the shaft 34 extends to a height coplanar with the upper surface of the latch member 48, while in the mechanism 132 the shaft 134 extends to a height coplanar with the upper surface of the upper bearing member 136. In both mechanism embodiments, the associated upper and lower latch members have practically identical appearances when installed.

As will be apparent from the foregoing description, door control mechanisms embodying the preferred practice of the present invention provide an inexpensive and simple technique enabling manufacturers of load carrying compartments to modify standard door control mechanisms to fit load carrying compartments of a wide range of heights.

Although the invention has been described in its preferred form with a certain degree of particularity, it is understood that the present disclosure of the preferred forms has been made only by way of example and that numerous changes in the details of construction and the combination and arrangements of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A door control mechanism for securing a door, swingable about an axis, in closed position closing a door opening defined by a door frame, the door control mechanism comprising:

(a) a shaft having a first end and a second hollow end;

(b) spaced bearing members receiving portions of the shaft for journaling the shaft on a swingable door with the axis of rotation of the shaft being spaced from and extending generally parallel to the door axis;

(c) means for rotating the shaft about its longitudinal axis;

(d) a first latch member, secured to the shaft near the first end, and having a first latch element;

(e) a second latch member having a second latch element;

(f) means connecting the second latch member to the shaft near the second end, including:

(i) a connecting member extending into the hollow end to a location lying alongside the second latch member: and, (ii) clamping means for clamping the shaft between the second latch member and the connecting member;

(g) first and second keeper members adapted to be affixed to a door frame at locations which are adjacent the first and second latch members, respectively, when the door is in its closed position for receiving the first and second latch elements to retain the door in its closed position;

(h) the clamping means including a fastener extending transversely through the second latch member, through the shaft and into the connecting member for captivating the shaft;

(i) the second latch member having a first unthreaded opening, the shaft having a second unthreaded opening, the connecting member having a threaded opening, and the fastener including an elongate threaded element threadably received in the threaded opening and passing through the unthreaded openings;

(j) the connecting member having a formation which engages the shaft to prevent the rotation of the connecting member relative to the shaft about the longitudinal axis of the fastener element; and, (k) the connecting member comprising a cylindrical plug extending from the terminus of the second shaft end to a location lying alongside the second latch member, and providing a head thereon larger than the opening in the second shaft end.

2. The door control mechanism of claim 1 wherein the second latch member carries a spacer member straddling the shaft for non-rotatably mounting the second latch member on the shaft during tightening of the threaded fastener.

3. The door control mechanism of claim 1 wherein the interior of the second shaft end and the exterior of the connecting member are complimentarily configured.

4. The door control mechanism of claim 1 wherein the second latch member is positioned at the terminus of the second shaft end and the second bearing member is spaced from the second latch member in the direction of the first shaft end.

5. The door control mechanism of claim 1 wherein the second bearing member is positioned at the terminus of the second shaft end and the second latch member is spaced from the second bearing member in the direction of the first shaft end.

* * * * *